United States Patent [19]

Breland et al.

[11] 4,340,253

[45] Jul. 20, 1982

[54] PREFLUSH-LIXIVIANT PROCESS FOR SOLUTION MINING OF URANIUM ORE BEDS

[75] Inventors: William M. Breland; Terry R. Guilinger; Robert S. Schechter, all of Austin, Tex.

[73] Assignee: The United States of America as represented by the Secretary of the Interior, Washington, D.C.

[21] Appl. No.: 168,816

[22] Filed: Jul. 10, 1980

[51] Int. Cl.[3] ..... E21B 43/28

[52] U.S. Cl. ..... 299/5; 423/17

[58] Field of Search ..... 299/4, 5; 166/274, 273; 423/17

[56] References Cited

U.S. PATENT DOCUMENTS

| | | | |
|---|---|---|---|
| 2,896,930 | 7/1959 | Menke | 299/5 |
| 3,087,539 | 4/1963 | Maurer, Jr. et al. | 166/274 |
| 3,792,903 | 2/1974 | Rhoades | 299/5 |
| 4,114,693 | 9/1978 | Foster et al. | 299/4 X |
| 4,258,955 | 3/1981 | Habib, Jr. | 299/5 |

*Primary Examiner*—Stephen J. Novosad

*Attorney, Agent, or Firm*—William S. Brown; Donald A. Gardiner

[57] ABSTRACT

A process for the in-situ mining of subterranean uranium ore deposits comprising pretreating the deposits by the steps of injecting an aqueous inorganic chloride solution therein to substantially saturate the deposits and injecting an aqueous alkaline lixiviant solution therein to flush the chloride solution from the deposits. Thereafter, the pretreated deposits may be solution mined in conventional fashion such as by injecting an oxidant-containing aqueous alkaline lixiviant therein and recovering uranium-containing lixiviant solution. The inorganic chloride solution is preferably potassium chloride and the preferred lixiviants are potassium carbonate, sodium carbonate and ammonium carbonate.

9 Claims, No Drawings

PREFLUSH-LIXIVIANT PROCESS FOR SOLUTION MINING OF URANIUM ORE BEDS

DESCRIPTION

TECHNICAL FIELD

This invention relates to the in-situ or solution mining of uranium and, more particularly, to the prevention of severe loss of subterranean formation permeability.

BACKGROUND ART

Conventional in-situ uranium solution mining is carried out by drilling an array of wells into the subteranean uranium ore deposit from the surface of the ground and injecting into the deposit, through one or more of these wells, an aqueous alkaline lixiviant solution, such as an alkaline carbonate, and an oxidant. The oxidant, which may typically be hydrogen peroxide or a dissolved oxygen bearing gas, converts the insoluble, tetravalent uranium values to the hexavalent state, in which form they are readily solubilized or complexed by the anion of the lixiviant solution. The lixiviant solution containing uranium values of solution is then pumped to the surface through one or more of the same wells and uranium is recovered therefrom in any convenient manner well known in the art. For a general description of the above process, reference can be made to Menke U.S. Pat. No. 2,896,930.

At present, most leaching is initiated by injecting an oxidant free solution of the carbonate lixiviant at the injection wells and producing at the production wells. Oxidant is not usually introduced at first because the cation exchange capacity requirements of the ore must first be satisfied before uranium leaching can begin. In aquifers whose groundwaters contain calcium and magnesium, severe precipitation may occur as the carbonate lixiviant is introduced. Much of this is believed due to the calcium and magnesium cations being displaced from the ion exchange minerals present in the ore by the cation of the carbonate lixiviant and then precipitating due to the high carbonate concentration in solution. This precipitation often causes undesirably large permeability declines.

The most frequently used carbonate lixiviant compound is ammonium carbonate since its use appears to minimize permeability decline. Sodium carbonate usually causes severe permeability damage in formations containing the widely occurring montmorillonite clays and potassium carbonate is very expensive relative to ammonium carbonate. However, ammonium carbonate has environmental drawbacks that the other two carbonates do not: first, ammonium ion is not usually present in natural groundwaters and second, ammonium ion has the potential to be converted to nitrite ion under certain conditions. Nitrite is very undesirable in groundwater since even relatively low concentrations may be harmful. For these reasons, after uranium leaching is completed, where ammonium carbonate has been used as the lixiviant, the ammonium ion level in the groundwater of the formation must be reduced to low levels. At least one method for this groundwater "restoration" is disclosed in Foster et al. U.S. Pat. No. 4,114,693.

Sodium is usually present in aquifers in fairly high concentrations (usually 100 ppm or more) and cannot be converted to a potentially deleterious compound as ammonium ions can. Thus, from a restoration standpoint, sodium carbonate is the lixiviant carbonate of choice. However, the permeability problems it commonly causes usually preclude its use. Potassium is also usually present in groundwater, although in lesser amounts (about 10 ppm) than sodium, and it also does not have the potential to be converted to a potentially deleterious compound. From a restoration standpoint then, it is a better lixiviant candidate than ammonium, but not sodium. From a permeability standpoint, it works about as well as ammonium and considerably better than sodium. The main drawback in the use of potassium carbonate as a lixiviant is its expense.

DISCLOSURE OF THE INVENTION

It is therefore, an object of this invention to provide a process for the solution mining of uranium ores whereby the formation of permeability reducing precipitates is minimized.

It is another object of this invention to provide a process for the solution mining of uranium ores whereby groundwater contamination by potentially harmful compounds is minimized.

It is still another object of this invention to provide a carbonate lixiviant process for solution mining of uranium ores wherein permeability decline of subterranean formations is reduced, groundwater contamination is reduced and the overall economics of the process is improved over heretofore known processes.

Other objects and advantages will become apparent from the following description and appended claims.

Briefly stated, the aforesaid objects are attained by a process which comprises two essential stages. In the first stage, the subterranean formations containing uranium deposits are pretreated by injecting an aqueous inorganic chloride flush solution into the formation until the cation exchange capacity requirements of the ore are met. In the second stage, an aqueous alkaline carbonate lixiviant solution is injected into the formation to flush out the chloride preflush solution, its reaction, ionexchange and/or displacement products. Thereafter, as is conventional in the art, an aqueous alkaline carbonate lixiviant containing an oxidant may be introduced to leach the uranium values from the ore. By judicious selection of the inorganic chloride solution cation and the aqueous alkaline carbonate cation, the practice of this preflush-lixiviant pretreatment process reduces permeability decline in the formation and reduces the loss of expensive lixiviant by precipitation, sorption or other mechanisms which lead to retention or chemicals in the formation. The process of the present invention is particularly effective in formation whose groundwaters contain calcium and/or magnesium ions.

BEST MODE FOR CARRYING OUT INVENTION

It has been found, as previously noted, that each of the most common aqueous alkaline carbonate lixiviants, namely ammonium carbonate, sodium carbonate and potassium carbonate, are disadvantageous for one or more reasons. Thus, ammonium carbonate contaminates groundwaters, sodium carbonate causes severe permeability decline and potassium carbonate, although functionally most preferable, is most expensive. However, by using an inorganic chloride preflush, the amount of lixiviant necessary is considerably reduced and, therefore, the process expense attributable to the lixiviant is decreased. Since the chloride of potassium is considerably cheaper than the carbonate of potassium, by employing potassium chloride instead of potassium carbonate to satisfy the cation exchange capacity requirements of the ore, the average cost of the lixiviant is considerably reduced.

To exemplify the foregoing, consider an ore with a cation exchange capacity of 10 milliequivalents per 100 grams of ore and a porosity of 35% being leached by a 2 grams of carbonate per liter of pore volume lixiviant. There are seven times as many milliequivalents of cations on the ion exchange minerals than in the lixiviant in the pore spaces. Based upon 1979 costs, a prior art system using only a potassium carbonate lixiviant is about eight times as expensive (excluding oxidant costs) as a similar system using only an ammonium carbonate lixiviant. If the process of the present invention is used, and a potassium chloride preflush precedes the potassium carbonate lixiviant, the process of the present invention is only 1.7 times more expensive than the pure ammonium carbonate system. However, this comparison takes into account only the costs of recovering uranium values from the subterranean formation and not the costs incident to restoring the groundwaters. Inasmuch as the restoration costs of the potassium chloride-potassium carbonate system are minimal and the costs associated with the ammonium carbonate system are substantial, the overall cost comparison renders the process of the present invention most attractive. In an ammonium chloride preflush preceded the ammonium carbonate lixiviant, the mixed ammonium system is about 1.14 times more expensive than the mixed potassium system. In situations where groundwater restoration is not a problem and there are, therefore, no objections to use of an ammonium containing lixiviant, the combination of a potassium chloride preflush followed by an ammonium carbonate lixiviant results in least expense while at the same time minimizes permeability decline. Overall, the mixed potassium chloride-ammonium carbonate system (which is effective in minimizing permeability decline) is about 20% less expensive than the typical prior art system which used no preflush and only an ammonium carbonate lixiviant (which does not minimize permeability declines).

Thus, it can be seen that by judicious selection of an inorganic chloride solution cation, the amount of precipitation that occurs is minimized and hence the extent of permeability decline is reduced. This is because the chlorides of magnesium and calcium are very soluble and, when these cations are displaced from the ion exchange materials in the formation, cause little precipitation in the high chloride solution. Likewise, by judicious selection of an inorganic chloride solution cation, the chloride preflush solution can be less expensive than the lixiviant solution and when used in lieu of the lixiviant solution to satisfy the cation exchange capacity requirements of the ore will result in an overall process cost savings. Finally, by judicious selection of an aqueous alkaline carbonate cation, permeability decline and groundwater restoration problems can be minimized.

The preferred chloride-lixiviant combination of the present invention is potassium chloride-potassium carbonate. However, depending upon the circumstances potassium chloride-ammonium carbonate or potassium chloride-sodium carbonate are also desirable. In some situations ammonium or sodium chloride preflushes can be used, although these are substantially less desirable than potassium chloride preflushes for reasons related to permeability decline, groundwater restoration and/or economics. If desired, mixtures of chloride cations and/or carbonate cations may be used. In addition, the carbonate cations for the lixiviant used for flushing the chloride solution and for the lixiviant used for solution mining may, if desired, be different.

The present invention will be better understood from a consideration of the overall process employing potassium chloride as the preflush aqueous inorganic chloride solution and potassium carbonate as the only aqueous alkaline lixiviant solution. Initially a potassium chloride preflush solution is pumped through the formation until the ore is saturated or substantially saturated with potassium. The resulting chloride solution is high in calcium and/or magnesium and, of course, potassium. This solution can either be sent to a holding pond for eventual discard or treated to remove the high calcium content and then recycled for reuse. Recycling is most likely to be practiced in areas where groundwater is relatively valuable or holding ponds too expensive. After the formation is saturated or substantially saturated with potassium, the potassium carbonate lixiviant (containing no potassium chloride) is injected into the formation to displace the potassium chloride preflush solution containing the calcium or magnesium ions. This displacement is necessary for two reasons. First, the preflush solution, high in calcium or magnesium, must be removed to prevent in situ reaction to form insoluble carbonates and cause permeability decline. Second, currently available anion exchange resins are unable to efficiently extract uranium from solutions having high chloride contents. Once the chloride preflush has been flushed from the formation, conventional in-situ solution mining or uranium can commence. This is accomplished by adding an appropriate oxidant to the carbonate lixiviant, injecting the lixiviant and oxidant, recovering a leach solution containing uranium values and recovering uranium from the solution in conventional manner, all as is well known in the art.

INDUSTRIAL APPLICABILITY

The practice of this invention permits the in-situ solution mining of subterranean uranium deposits in a manner which minimizes permeability decline and groundwater contamination. By treating the subteranean formations with chloride preflushes prior to lixiviant and oxidant injection the loss of expensive lixiviant by precipitation, displacement or other mechanisms is avoided. At the same time the overall economics of the process is improved by savings in lixivant costs, groundwater restoration costs and permeability restoration costs.

We claim:

1. A process for the in-situ mining of subterranean uranium ore deposits containing cations which form carbonate precipitates, comprising the steps of:

(a) pretreating the subterranean deposit by injecting aqueous inorganic chloride solution into said deposit to substantially saturate said deposit, whereby said cations are displaced from said deposit into said chloride solution;

(b) injecting a first aqueous alkaline lixiviant solution into said deposit to flush said cation-containing chloride solution therefrom;

(c) injecting a second aqueous alkaline lixiviant solution containing an oxidant into said deposit to leach uranium values from said deposit; and (d) recovering the uranium containing lixiviant solution.

2. A process, as claimed in claim 1, wherein said inorganic chloride solution is selected from the group consisting of potassium chloride, sodium chloride, ammonium chloride and mixtures thereof.

3. A process, as claimed in claim 1, wherein said inorganic chloride solution is potassium chloride.

4. A process, as claimed in claims 1, 2 or 3 wherein said first and second aqueous lixiviant solutions are selected from the group consisting of ammonium carbonate, potassium carbonate sodium carbonate and mixtures thereof.

5. A process, as claimed in claim 4, wherein said first and second aqueous alkaline lixiviant solutions are potassium carbonate.

6. A process, as claimed in claim 1, wherein said inorganic chloride solution is potassium chloride, said first and second aqueous alkaline lixiviant solutions are potassium carbonate and said oxidant is selected from the group consisting of hydrogen peroxide and dissolved oxygen bearing gases.

7. In a method of in-situ solution mining or uranium values from subterranean uranium ore deposits including the steps of injecting a first aqueous alkaline lixiviant solution containing an oxidant into said deposits and pumping to the surface first lixiviant solution containing uranium values in solution, the improvement comprising the steps of:

pretreating said deposits prior to injecting said oxidant containing first lixiviant solution therein by injecting an aqueous inorganic chloride solution selected from the group consisting of potassium chloride, sodium chloride, ammonium chloride and mixtures thereof into said deposits to substantially saturate said deposits and injecting a second aqueous alkaline lixiviant solution into said deposits to flush said chloride solution therefrom.

8. A method, as claimed in claim 7, wherein said first and second aqueous alkaline lixiviant solutions are selected from the group consisting of ammonium carbonate, potassium carbonate, sodium carbonate and mixtures thereof.

9. A method, as claimed in claim 7, wherein said first and second aqueous alkaline lixiviant solutions are potassium carbonate and said inorganic chloride solution is potassium chloride.

* * * * *